US006379284B1

(12) United States Patent
Hanai et al.

(10) Patent No.: US 6,379,284 B1
(45) Date of Patent: Apr. 30, 2002

(54) FUEL INJECTION CONTROL APPARATUS FOR ENGINES

(75) Inventors: Akihiro Hanai, Obu; Mikio Hamada, Handa; Yasuaki Kyokane, Tokyo; Takahiro Aki, Kobe, all of (JP)

(73) Assignees: Aisan Kogyo Kabushiki Kaisha, Obu (JP); Fujijukogyo Kabushiki Kaisha, Tokyo (JP); Fujitsu Ten Kabushiki Kaisha, Kobe (JP)

( * ) Notice: Subject to any disclaimer, the term of this patent is extended or adjusted under 35 U.S.C. 154(b) by 0 days.

(21) Appl. No.: 09/570,430

(22) Filed: May 12, 2000

(30) Foreign Application Priority Data

May 18, 1999 (JP) ..... 11-136547

(51) Int. Cl.[7] ..... F02D 5/00
(52) U.S. Cl. ..... 477/200; 123/491
(58) Field of Search ..... 123/491, 179.16, 123/179.3; 477/184, 200; 290/38 E

(56) References Cited

U.S. PATENT DOCUMENTS 3,925,970 A * 12/1975 Rusco ..... 180/343 X
4,278,143 A * 7/1981 Nagai ..... 180/282
4,508,083 A * 4/1985 Hasegawa et al. ..... 123/491
4,541,390 A * 9/1985 Steinbrenner et al. ..... 123/491
4,883,028 A * 11/1989 Wu ..... 123/179.3
5,105,689 A * 4/1992 Korsmeyer ..... 477/68 X
5,293,517 A * 3/1994 Andruet ..... 318/266
5,657,730 A * 8/1997 Gustavsson ..... 123/179.16 X

FOREIGN PATENT DOCUMENTS

JP A-58-41229 3/1983

* cited by examiner

*Primary Examiner*—Charles A Marmor
*Assistant Examiner*—Ankur Parekh
(74) *Attorney, Agent, or Firm*—Oliff & Berridge, PLC

(57) ABSTRACT

A fuel injection control apparatus for engines used in vehicles, particularly, a golf-cart is disclosed. An engine 1 is operated by means of an accelerator pedal 15 and is assisted with its startup by a starter 7. An injector 17 is controlled to inject fuel pumped by a fuel pump 19 into an air-intake passage 2. A controller 40 controls the starter 7, the injector 17, and the fuel pump 19, and others. Upon depression of the accelerator pedal 15 to start up the engine 1, the controller 40 actuates the starter 7 and simultaneously actuates the injector 17 only one time for initial injection. Specifically, the controller 40 controls such that the initial injection and the ignition associated therewith are performed even if no pulse signal is input from a crank angle sensor 33.

7 Claims, 4 Drawing Sheets

AS
(%)
100
0
STARTUP DEMAND STROKE
UPPER LIMIT OF ON-STARTUP ROTATIONAL SPEED

NE
800

STE
E1
0

PULSE SIGNAL

INITIAL INJECTION

ON-STARTUP INJECTION

POST-STARTUP INJECTION

TOTAL INJECTION
t1
t2
t3
t4

FUEL INJECTION CONTROL APPARATUS FOR ENGINES

BACKGROUND OF THE INVENTION

1. Field of the Invention

The present invention relates to a fuel injection control apparatus for controlling fuel to be injected into engines used in industrial vehicles and the like and, more particularly, to a fuel injection control apparatus for engines for controlling fuel injection at a startup time of the engines.

2. Description of Related Art

Conventionally, there have been proposed some control apparatus and methods for accurately controlling fuel to be supplied to engines of vehicles by controlling an injector (a fuel injection valve) to inject the fuel into an air-intake passage according to operating conditions of the engines.

Paying particular attention to a startup performance of the engines, there is an apparatus adopting a fuel injection control which is exercised at startup in proportion to engine cranking caused by a starter.

An example of such the fuel injection control apparatus is disclosed in Japanese patent unexamined publication No. SHO 58(1983)-41229. The control apparatus disclosed in the publication is arranged such that even if a driver carelessly depresses an accelerator pedal to demand acceleration during the startup (the cranking) of an engine, the amount of fuel to be injected at startup is not compensated to increase.

When the engine is started without depression of the accelerator pedal, the valve opening time of an injector is controlled to provide a predetermined air-fuel ratio based on outputs of an air-flowmeter and a crank angle sensor. Specifically, the fuel injection amount is controlled based on an air-intake amount detected by the air-flowmeter and a pulse signal output from the crank angle sensor which detects variations in rotational angle of a crankshaft. Even if a driver inadvertently depresses the accelerator pedal to demand acceleration during startup of the engine cranked by the starter which is in an ON state, a control operation circuit distinguishes that the engine is in the startup state based on an ON signal from a starter switch and cancels increase compensation of the fuel injection amount.

Meanwhile, the conventional fuel injection control mentioned above is arranged so that the increase compensation is not performed even if the accelerator pedal is pressed down during startup of the engine. As a result, the fuel would not be supplied in excess amounts, preventing deteriorations in startability of the engine. This fuel injection control is, however, performed based on the pulse signal indicative of the engine rotation speed detected by the crank angle sensor during the startup. If the pulse signal is not detected immediately after the start of cranking, the injector is not allowed to inject the fuel until a pulse signal is detected. Thus, the startup (or cranking) of the engine is delayed and a period of time needed for the startup is liable to become longer.

Although the startup time is prolonged, such the startup delay is considered as having little effect on driving operations of the vehicles using the engines which are cranked with an engine (ignition) key. On the other hand, if the above fuel injection control apparatus is adopted in the engines of industrial vehicles, such as a golf-cart, arranged such that cranking, traveling and stopping are performed in proportion to operations of the accelerator pedal, such the engine of the golf-cart would cause troubles at startup, for example, in a parked position (when stopping) on a slope.

Specifically, the golf-cart using a parking brake is constructed such that the parking brake is released when the accelerator pedal is depressed by a driver. When the accelerator pedal is depressed to start the engine of the cart parked on a slope, therefore, cranking of the engine is started simultaneously with depression of the accelerator pedal, while the parking brake is also released at the same time. At this time, if the startup of the engine is delayed after release of the parking brake as described above, the golf-cart on the slope is consequently liable to unexpectedly move under its own weight in correspondence with the startup delay, which may possibly give anxiety to the driver.

SUMMARY OF THE INVENTION

The present invention has been made in view of the above circumstances and has an object to overcome the above problems and to provide a fuel injection control apparatus for engines capable of preventing startup delay of the engines.

Additional objects and advantages of the invention will be set forth in part in the description which follows and in part will become understood from the description, or may be learned by practice of the invention. The objects and advantages of the invention may be realized and attained by means of the instrumentalities and combinations particularly pointed out in the appended claims.

To achieve the purpose of the invention, there is provided a fuel injection control apparatus for engines, the apparatus being provided in an engine of which startup is assisted by a startup assist device and operation is controlled by operation control means, and being arranged to control fuel injection means to inject fuel to be supplied to the engine based on operating conditions of the engine, the apparatus including: startup injection control means for actuating the startup assist device and for causing the fuel injection means to perform initial injection when the operation control means is operated to start the engine.

According to the fuel injection control apparatus of the present invention, the initial injection is performed by means of the fuel injection means in substantial synchronism with the actuation of the startup assist device, so that the startup delay of the engine can be prevented, thus shortening the period of time needed for the startup of the engine.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a fuel injection control apparatus for engines embodying the present invention will now be given referring to the accompanying drawings.

Figure 1:
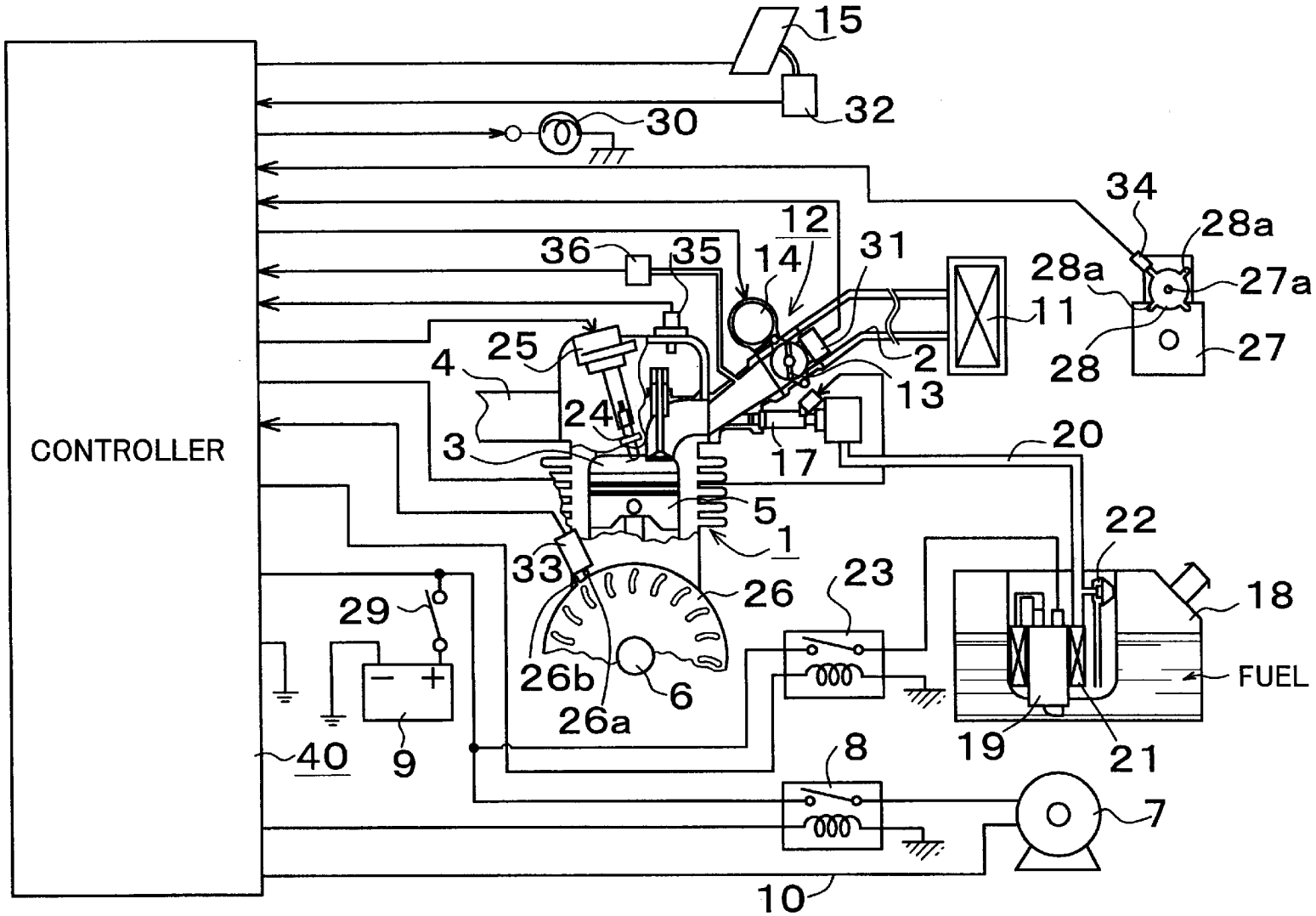
FIG. 1 is a schematic structural view of an engine system in an embodiment according to the present invention.

FIG. 1 is a schematic structural view of an engine system in the present embodiment, in which the system is mounted on a golf-cart which is one of industrial vehicles. An engine 1 is a single cylinder reciprocating engine having a well-known structure. This engine 1 is arranged such that fuel and air supplied thereto through an air-intake passage 2, that is, a combustible fuel-air mixture explodes and burns in a combustion chamber 3, and then a resultant exhaust gas is exhausted through an exhaust passage 4, thereby driving a piston 5 to rotate a crankshaft 6, producing power.

A starter 7 drivingly connected to the crankshaft 6 is a startup assist device of the present invention. This starter 7 is driven to assist the startup of the engine 1. A starter relay 8 provided for the starter 7 is turned on or off for controlling supply of electric power to the starter 7. After startup of the engine 1, alternatively, the starter 7 is driven by the power produced in the engine 1, thus functioning as a dynamo. The electric power generated in the starter 7 is supplied to a battery 9 through an unillustrated power cord.

An air cleaner 11 for cleaning the air to be taken in the air-intake passage 2 is disposed in the passage 2. An electronic throttle device 12 disposed in the intake passage 2 will be opened or closed in order to regulate an amount of air (intake air) that is sucked through the passage 2 into the combustion chamber 3. This electronic throttle device 12 is constructed of a throttle valve 13 disposed in the intake passage 2, a DC motor 14 for driving the valve 13, and a throttle sensor 31 for detecting a throttle opening TA (throttle aperture) of the throttle valve 13. The throttle sensor 31 detects the throttle opening TA and outputs an electric signal indicative of the detection value.

The electronic throttle device 12 constructed as above is operated in accordance with a depressed degree of an accelerator pedal 15 provided near a driver's seat and a vehicle speed. The accelerator pedal 15 is, as well known, to control the driving operations of the vehicle including acceleration and deceleration of the engine 1. Upon release from a depressed state, the accelerator pedal 15 is returned to an original position, at which the driving operations are not controlled. An accelerator sensor 32 is provided in connection with the accelerator pedal 15 for detecting a depressed degree of the accelerator pedal 15, namely, an accelerator stroke SA, and for outputting an electric signal indicative of the detection value.

An injector 17 is arranged at an air-intake port communicating with the combustion chamber 3. The injector 17 serves to supply the fuel pumped by a fuel pump 19 from a fuel tank 18 through a fuel pipe 20 in an injection manner into the air-intake port. Those injector 17, fuel tank 18, and fuel pump 19 and others constitute a fuel supply device. The motor-driven fuel pump 19 contained in the fuel tank 18 pumps up the fuel stored in the tank 18 to the injector 17. A fuel filter 21 is attached to the pump 19 for filtering the fuel. A pressure regulator 22 is also connected to the pump 19 for regulating the pressure of the fuel to be pumped to the injector 17 at a constant pressure. A pump relay 23 is connected to the pump 19 and will be turned on or off for controlling supply of electric power to the pump 19.

When the fuel pump 19 is actuated upon turn-on of the pump relay 23, the fuel in the fuel tank 18 is pumped to the injector 17 through the fuel filter 21, fuel pump 19, and fuel pipe 20. The fuel fed to the injector 17 is injected into the air-intake port in association with operations of the injector 17, and supplied into the combustion chamber 3 along with the air flowing in the air-intake passage 2.

In the engine 1, an ignition plug 24 is located corresponding to the combustion chamber 3. This plug 24 is operated in response to high voltage output from an ignition coil 25. This coil 25 is to output high voltage for ignition to the ignition plug 24 according to variations of rotational angles of the crankshaft 6 and pressures in the air-intake pipe. An actuation timing of the ignition plug 24, namely, an ignition timing is determined in response to an output timing of the high voltage output from the ignition coil 25. That is to say, controlling the ignition coil 25 will control the operation of the plug 24.

A flywheel 26 is fixed to the crankshaft 6. A crank angle sensor 33 constructed of an electromagnetic pickup is disposed opposite the periphery of the flywheel 26. This crank angle sensor 33 detects a rotational speed of the crankshaft 6, i.e., an engine rotational speed NE, and outputs an electric signal representative of the detection value. On the periphery of the flywheel 26 are provided a pair of protrusions 26*a* and 26*b* disposed adjacent each other. Upon rotation of the crankshaft 6, the flywheel 26 is rotated together, thus causing the protrusions 26*a* and 26*b* to pass beneath the sensor 33. Every time the sensor 33 detects the passage of the protrusion 26*a* (26*b*), the sensor 33 outputs one pulse signal. In the present embodiment, therefore, for one rotation of the crankshaft 6, the sensor 33 consecutively outputs two pulse signals corresponding to the pair of protrusions 26*a* and 26*b*.

A transmission 27 drivingly connected to the crankshaft 6 is provided with a vehicle speed sensor 34 for detecting a vehicle speed SP of the golf-cart. This transmission 27 serves to transmit the rotation of the crankshaft 6 to a drive wheel not shown. On a gear shaft 27*a* of the transmission 27 is mounted a rotor 28 with four projections 28*a* spaced at equally angular intervals on the periphery of the rotor 28. The vehicle speed sensor 34 is constructed of an electromagnetic pickup disposed opposite the periphery of the rotor 28. Accordingly, upon rotation of the gear shaft 27*a*, the rotor 28 is rotated together and each of the projections 28*a* passes beneath the sensor 34. Every time the sensor 34 detects the passage of one of the projections 28*a*, the sensor 34 outputs one pulse signal.

The engine 1 is provided with an oil temperature sensor 35 for detecting the temperature THO of lubricating oil flowing in the inside of the engine 1 and then outputting an electric signal representative of the detection value. This oil temperature THO reflects a temperature condition of the engine 1. In the air-intake passage 2, disposed is a sensor 36 for detecting the pressure PM in the passage 2, or the air-intake pressure, and outputting an electric signal indicative of the detection value.

In the present embodiment, the above mentioned throttle sensor 31, crank angle sensor 33, vehicle speed sensor 34, oil temperature sensor 35, air-intake pressure sensor 36 and others constitute operating condition detection means for detecting operating conditions of the engine 1. The accelerator sensor 32 constitutes operation control amount detecting means for detecting an accelerator stroke AS as the operated amount of the engine 1. A check lamp 30 commonly arranged in front of a driver's place is lighted upon turn-on of a power key switch 29. The lighted lamp 30 indicates that a controller 40 is electrically powered.

In the present embodiment, various signals output from the above mentioned sensors, namely, the throttle sensor 31, accelerator sensor 32, crank angle sensor 33, vehicle speed sensor 34, oil temperature sensor 35, and air-intake pressure sensor 36 are input to the controller 40. Similarly, the signal indicative of the voltage generated between terminals of the starter 7 is input to the controller 40 through a detection cord 10. Upon input of those signals, the controller 40 correspondingly controls the starter relay 8, DC motor 14, injector 17, ignition coil 25, pump relay 23, and check lamp 30, respectively, for execution of the fuel injection control including on-startup injection control; the ignition control; the electronic throttle control; and the fuel pump control. The controller 40 in the present embodiment constructs startup injection control means of the present invention.

The controller 40 is provided with well-known elements, that is, a central processing unit (CPU), a read only memory (ROM), a random access memory (RAM), a backup RAM, an external input circuit, and an external output circuit. The controller 40 provides a logic operation circuit by connecting the CPU, ROM, RAM, and backup RAM with the external input circuit and the external output circuit through busses. The ROM is to store in advance predetermined programs related to the above various controls. The RAM is to temporarily store operation results of the CPU. The backup RAM is to save the data stored in advance. The CPU is to exercise various controls in accordance with the predetermined control programs based on the detection values transmitted from the sensors 31-36 and input to the CPU through the input circuit.

Meanwhile, the fuel injection control means controlling the amount of fuel to be injected (fuel injection amount) from the injector 17 and the injection timing according to the operating conditions of the engine 1. The on-startup injection control means controlling the injector 17 during cranking of the engine 1. The ignition control means controlling the ignition coil 25 according to the rotation of the crankshaft 6 to control an ignition operation of the ignition plug 24. The electronic throttle control means calculating a target opening based on the detected accelerator stroke AS and controlling the DC motor 14 so that the throttle opening TA becomes the target opening. The fuel pump control means controlling the pump relay 23 based on the detected accelerator stroke AS and thereby controlling the fuel pump 19 along with the starter 7.

In the present embodiment, the fuel injection control, the ignition timing control, and the electronic throttle control are started when the accelerator sensor 32 detects depression of the accelerator pedal 15. Accordingly, even if the controller 40 is electrically powered by turn-on of the power key switch 29, the engine 1 does not crank unless the accelerator pedal 15 is depressed. Thus, no idling condition exists in the operating conditions of the engine 1 of the golf-cart in the present embodiment.

The golf-cart in the present embodiment adopts a parking brake not shown. This parking brake releases a braking operation when the accelerator pedal 15 is pressed down. Specifically, this golf-cart is designed such that, upon depression of the accelerator pedal 15, the starter 7 is actuated to start cranking of the engine 1 and the parking brake is released at the same time.

Figure 2:
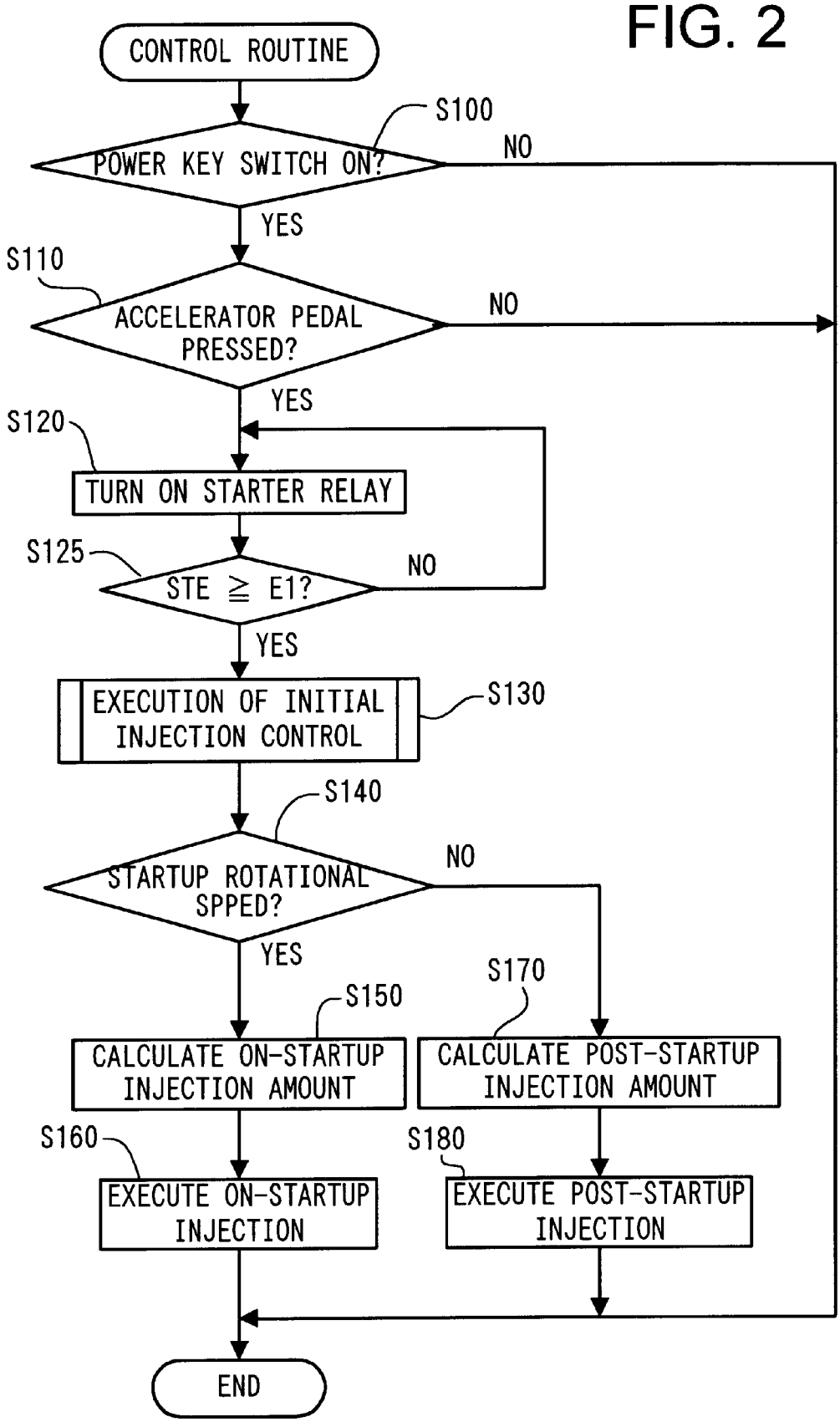
FIG. 2 is a flowchart of a processing routine of fuel injection control in the embodiment.
Figure 3:
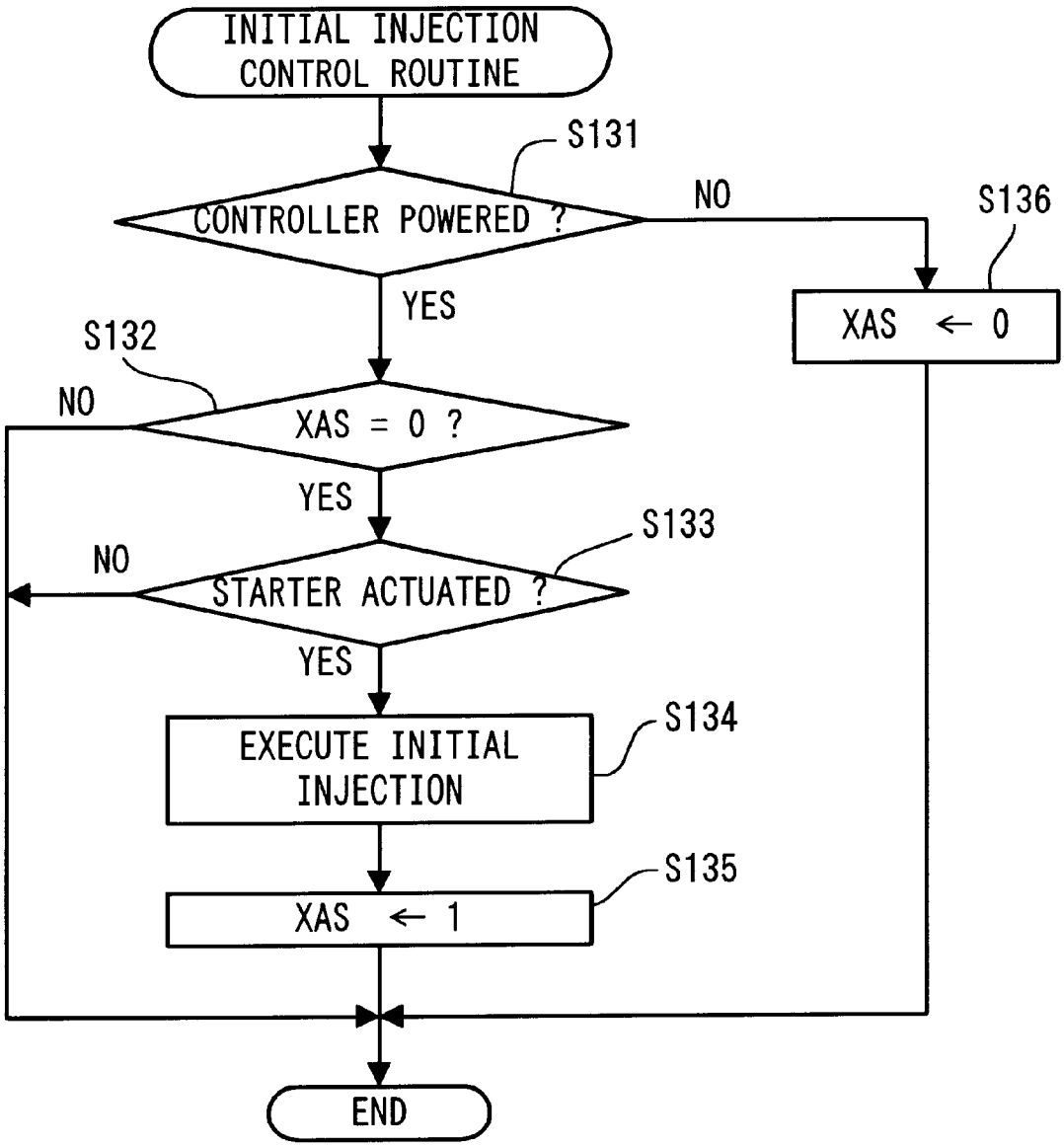
FIG. 3 is a flowchart of a processing routine of initial injection control in the embodiment.

Next, detailed explanation is made on processing contents of the fuel injection control including the on-startup injection control. FIGS. 2 and 3 are flowcharts of routines of the processing contents.

The controller 40 exercises periodically the routine shown in FIG. 2 at a predetermined intervals. In step (hereinafter abbreviated as S) 100, the controller 40 determines whether or not the power key switch 29 is turned on, more specifically, whether the controller 40 is electrically powered. If the power key switch 29 is not turned on (S100: NO), the controller 40 temporarily terminates the subsequent steps. If the switch 29 is turned on (S 100: YES), the controller 40 advances the step to S110.

In S110, the controller 40 determines whether or not the accelerator pedal is depressed. This determination is made depending on whether the accelerator stroke AS detected by the accelerator sensor 32 is larger than a predetermined startup demand stroke or more, or, is smaller than a predetermined stop demand stroke or less. If the pedal 15 is not depressed (S110: NO), the controller 40 temporarily terminates the subsequent steps. If the pedal 15 is depressed (S110: YES), the controller 40 goes to S120.

In S120, the controller 40 turns on the starter relay 8 to actuate the starter 7.

In S125, subsequently, the controller 40 determines whether or not a value of the voltage STE between the starter terminals, the signal representative of the voltage value being input to the controller 40 through the detection cord 10, is larger than a predetermined reference value E1 or more. If the value of the voltage STE is smaller than the reference value E1 (S125: NO), the controller 40 waits until the voltage value becomes larger than the reference value E1 or more. Then, when the value of the voltage STE becomes larger than the reference value E1 or more (S125: YES), the flow is advanced to S130.

In S130, the controller 40 executes the initial injection control. FIG. 3 is a flowchart of the processing contents of this initial injection control.

In S131, at first, the controller 40 confirms whether it is powered. If the controller 40 is not powered (S131: NO), it resets an initial injection execution flag XAS to "0" in S136 and temporarily ends the subsequent steps. If the controller 40 is powered (S131: YES), alternatively, the flow is advanced to S132.

In S132, the controller 40 judges whether or not the initial injection execution flag XAS is "0". If the flag XAS is not "0" (S132: NO), the controller 40 judges that the initial injection has already been executed and temporarily terminates the subsequent steps. If the flag XAS is "0" (S132: YES), it judges that the initial injection has not been executed yet and advances the step to S133.

In S133, the controller 40 determines whether or not the starter 7 is in an actuated state. If the starter 7 is not actuated (S133: NO), the controller 40 temporarily ends the subsequent steps. If the starter 7 is actuated (S133: YES), the controller 40 judges that the execution conditions for initial injection are fulfilled and goes to S134.

In S134, the controller 40 controls the injector 17 to perform the initial injection in substantial synchronism with actuation of the starter 7.

After that, in S135, the controller 40 sets the initial injection execution flag XAS to "1" and temporarily terminates the subsequent steps.

Specifically, in S100–S130, the controller 40 controls such that the injector 17 performs the initial injection only one time at substantially the same time with actuation of the starter 7 when the accelerator pedal 15 is depressed to start the engine 1.

Returning to FIG. 2, in S140 following the S130, the controller 40 determines whether or not a value of the engine rotational speed NE detected by the crank angle sensor 33 is a predetermined value of an on-startup rotational speed. This on-startup rotational speed value is set in advance with an upper limit of a certain reference value, for example, 800 rpm in the present embodiment.

If the value of the engine rotational speed NE is the on-startup rotational speed value (S140: YES), the controller 40 calculates the amount of fuel to be injected at startup in S150. Specifically, the controller 40 refers to functional data determined in advance and calculates this on-startup injection amount based on a value of the oil temperature THO detected by the oil temperature sensor 35, that is, based on the temperature condition of the engine 1.

In S160, the controller 40 controls the injector 17 based on the calculated on-startup injection amount to perform the on-startup injection, and then temporarily terminates the subsequent steps.

In S140, to the contrary, if the detected value of the engine rotational speed NE is not the on-startup rotational speed value (S140: NO), the controller 40 calculates the amount of fuel to be injected after startup (post-startup) in S170. The controller 40 refers to functional data determined in advance and calculates the post-startup injection amount based on the engine rotational speed NE detected by the crank angle sensor 33 and the air-intake pressure PM detected by the air-intake pressure sensor 36, namely, based on the amount of air sucked into the engine 1.

Succeedingly, in S180, the controller 40 controls the injector 17 based on the calculated post-startup injection amount to perform the post-startup injection and then temporarily ends the subsequent steps.

Specifically, in S140–S180, the controller 40 controls the amount of the fuel to be injected from the injector 17 to be supplied to the engine 1 based on the operating conditions of the engine 1, that is, the oil temperature THO, the engine rotational speed NE, and the air-intake pressure PM.

Figures 4A, 4B, 4C, 4D, 4E, 4F, 4G, 4H:
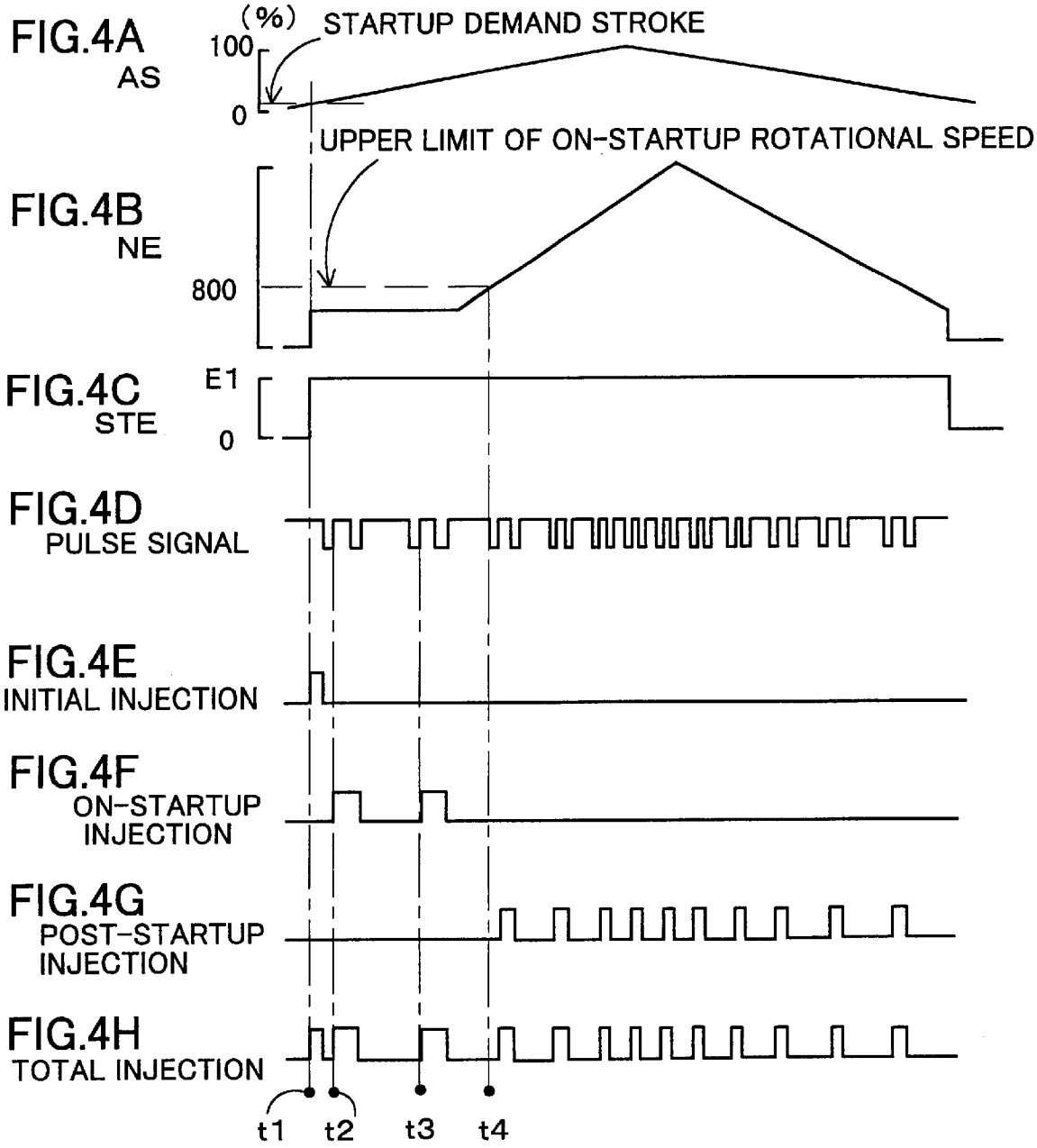
FIG. 4 is a time chart of actions of various parameters in the embodiment.

FIGS. 4A–4H are time charts of actions of various parameters in relation to the above controls. According to the fuel injection control apparatus in the present embodiment, when the accelerator pedal 15 is depressed to start up the engine 1, the accelerator stroke AS reaches the startup demand stroke at the time t1 as shown in FIG. 4A. Also, upon depression of the pedal 15, the starter 7 is actuated and the voltage STE between the starter terminals becomes the reference value E1 as shown in FIG. 4C. Simultaneously, as shown in FIG. 4E, the injector 17 performs the initial injection only one time. In association with the initial injection, as shown in FIG. 4B, the engine rotational speed NE rises once.

Then, when the pulse signal from the crank angle sensor 33 is input (FIG. 4D) and the value of the engine rotational speed NE is less than the upper limit (e.g., 800 rpm) of the on-startup rotational speed, the injector 17 is caused by the controller 40 to perform the on-startup injection at the times t2 and t3 respectively as shown in FIG. 4F.

When the engine rotational speed NE exceeds the upper limit and the corresponding pulse signal is input from the crank angle sensor 33 to the controller 40, the injector 17 is caused to perform the post-startup injection at the time t4 and the subsequent times as shown in FIG. 4G. Then, the engine rotational speed NE varies with fluctuations of the accelerator stroke AS.

FIG. 4H is a time series of total injection actions including the initial injection, the on-startup injection and the post-startup injection.

In the above description, only the fuel injection control is explained. The other controls, i.e., the ignition control, the electronic throttle control, and the fuel pump control and others are also performed separately in accordance with other unillustrated routines upon the depression of the accelerator pedal 15. In the present embodiment, the fuel pump 19 is activated concurrently with the actuation of the starter 7. The ignition coil 25 is controlled to turn on the ignition plug 24 to ignite the injected fuel every time each fuel injection is performed.

As described above in detail, in the fuel injection control apparatus in the present embodiment, upon depression of the accelerator pedal 15 for starting up the engine 1, the controller 40 actuates the starter 7 and simultaneously causes the injector 17 to perform the initial injection only one time, thereby causing combustion by the initial injection. After the initial injection, the startup of the engine 1 is assisted by the starter 7 and, accordingly, the injector 17 performs the on-startup injection and the post-startup injection sequentially. In association with each of the injections, combustion of the injected fuel is carried out. As a result, at the startup of the engine 1, the initial injection is performed simultaneously with the actuation of the starter 7, causing the combustion associated with the initial injection. Thus, in substantial synchronism with the actuation of the starter 7, the engine 1 can be started up without delay. This makes it possible to shorten the period of time from the start to complete of the startup of the engine 1.

More specifically, even if no pulse signal from the crank angle sensor 33 is input to the controller 40 immediately after the start of cranking of the engine 1 by the starter 7, the injector 17 is allowed to inject fuel only one time for the initial injection, avoiding the absence of injection for a period required until an initial pulse signal is input. Thus, the engine 1 can be started up right after the actuation of the starter 7.

In the present embodiment, the above fuel injection control which is adopted in the golf-cart using the parking brake can cope with the startup in a parked position on a slope. Specifically, upon depression of the accelerator pedal 15, the parking brake is released, while combustion is started at substantially the same time in the engine 1 due to the initial injection of fuel, thus starting up the engine 1 immediately. Accordingly, even when the parking brake of the golf-cart parked on a slope is released, the engine 1 being started up at substantially the same time, the golf-cart can be prevented from unexpectedly moving under its own weight, which provides a feeling of security to a driver of the golf-cart. In addition, the drivability of the golf-cart can be improved.

According to the fuel injection control apparatus in the present embodiment, the initial injection is performed by means of the injector 17 in synchronism with the actuation of the starter 7, so that the startup delay of the engine 1 can be prevented, thus shortening the period of time for the startup of the engine 1.

The present invention may be embodied in other specific forms without departing from the spirit or essential characteristics thereof.

In the above embodiment, for instance, the starter 7 is provided as an electric motor-driven startup assist device. Instead thereof, a cell dynamo may be used.

Although the accelerator pedal 15 is used as operation control means in the above embodiment, different control members such as an accelerator lever which is manually manipulated may be used.

In the above embodiment, the starter 7 that functions as a dynamo after completion of the startup of the engine 1 is provided as an electric motor-driven startup assist device. A starter designed for only assisting the startup of the engine 1 may be alternatively provided.

In the above embodiment, the initial injection is performed only one time concurrently with the actuation of the starter 7. Alternatively, the initial injection may be performed two or more times according to the period of time from the actuation of the starter 7 to the input of the initial pulse signal from the crank angle sensor 33 to the controller 40.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A fuel injection control apparatus for engines, the apparatus being provided in an engine of which startup is assisted by a startup assist device and operation is controlled by an operation control device, and being arranged to control a fuel injector to inject fuel to be supplied to the engine based on operating conditions of the engine, the apparatus detecting a rotational angle of a crankshaft and causing the injector to inject said fuel with respect to a predetermined rotational angle of the crankshaft, the apparatus comprising:

startup injection control means for actuating the startup assist device and for causing the fuel injector to perform a one-time injection for startup when the operation control device is operated to start the engine, without respect to the predetermined rotational angle.

2. The fuel injection control apparatus according to claim 1, wherein the operation control means includes an accelerator pedal which is operated to perform cranking, traveling, and stopping.

3. The fuel injection control apparatus according to claim 2, wherein operation of a parking brake of a vehicle is released when the accelerator pedal is depressed.

4. The fuel injection control apparatus according to claim 3, wherein the vehicle is a golf-cart.

5. The fuel injection control apparatus according to claim 1, wherein the engine includes a single cylinder reciprocating engine.

6. The fuel injection control apparatus according to claim 1, wherein the startup assist device includes an electric motor-driven starter, and the startup injection control means prohibits the one-time injection for startup when the electric motor-driven starter is in an inactive state.

7. The fuel injection control apparatus according to claim 6, wherein the startup injection control means controls the fuel injection means to perform the initial injection only when the injection control means detects that the starter is actuated.

* * * * *